US005553147A

United States Patent [19]

Pineau

[11] Patent Number: 5,553,147

[45] Date of Patent: Sep. 3, 1996

[54] STEREOPHONIC REPRODUCTION METHOD AND APPARATUS

[75] Inventor: Joseph E. M. Pineau, Calgary, Canada

[73] Assignee: One Inc., Alberta, Canada

[21] Appl. No.: 60,339

[22] Filed: May 11, 1993

[51] Int. Cl.[6] ..... H04R 5/02

[52] U.S. Cl. ..... 381/24; 381/89

[58] Field of Search ..... 381/24, 89, 182, 381/88, 90, 193, 86; 181/144, 145

[56] References Cited

U.S. PATENT DOCUMENTS

| | | | |
|---|---|---|---|
| 2,791,628 | 5/1957 | Edmondson . | |
| 3,350,514 | 10/1967 | Cooke . | |
| 3,979,566 | 9/1976 | Willy | 381/193 |
| 3,995,124 | 11/1976 | Gabr . | |
| 4,268,719 | 5/1981 | Manger | 381/89 |
| 4,472,605 | 9/1984 | Klein | 381/89 |
| 4,783,820 | 11/1988 | Lyngdorf et al. | 381/89 |
| 4,836,329 | 6/1989 | Klayman . | |
| 4,837,826 | 6/1989 | Scupbach | 381/24 |
| 5,046,103 | 9/1991 | Warnaka et al. . | |
| 5,109,416 | 4/1992 | Croft . | |
| 5,119,420 | 6/1992 | Kato et al. | 381/86 |
| 5,164,549 | 11/1992 | Wolf . | |
| 5,253,301 | 10/1993 | Sakamoto et al. | 381/89 |
| 5,323,466 | 6/1994 | Geddes | 381/89 |

FOREIGN PATENT DOCUMENTS

| | | |
|---|---|---|
| 0036337 | 9/1981 | European Pat. Off. . |
| 2709952 | 9/1978 | Germany . |
| 1139770 | 1/1969 | United Kingdom . |

OTHER PUBLICATIONS

Patent Abstracts Of Japan vol. 9, No. 280 (E–356) 8 Nov. 1985 & JP, A, 60 121 900 (Nihon Atsudenki) 29 Jun. 1985.

Tremaine, Howard, *The Audio Cyclopedia*, Samas Publishing, 1979, p. 1138.

*Primary Examiner*—Forester W. Isen

*Attorney, Agent, or Firm*—Jordan & Hamburg

[57] ABSTRACT

A method and apparatus for stereophonic reproduction uses conventional left and right stereophonic signals to energize a point source transducer in a complementary manner. The resultant interference sound pattern is interpreted by the brain of a listener to enable the listener to experience stereophonic hearing in a wide region surrounding the transducer, not just in the region of the plane of symmetry. A point source transducer may be simulated by a plurality of transducers positioned with the spacing therebetween less than a determinable maximum distance. While conventional stereophonic signals may be employed in the reproduction of sound, improved reproduction is obtained by producing the signals by recording sound with a pair of microphones arranged with the apogees of their respective field of polar response patterns facing substantially at 180° to one another.

19 Claims, 7 Drawing Sheets

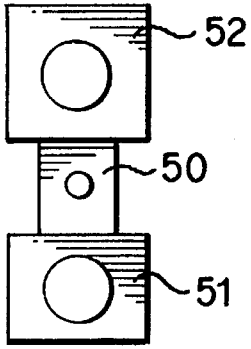
FIG. 9
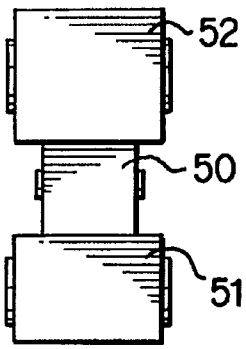
FIG. 8
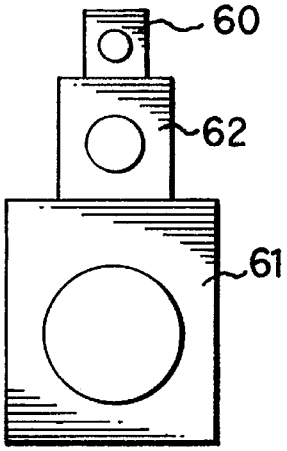
FIG. 11
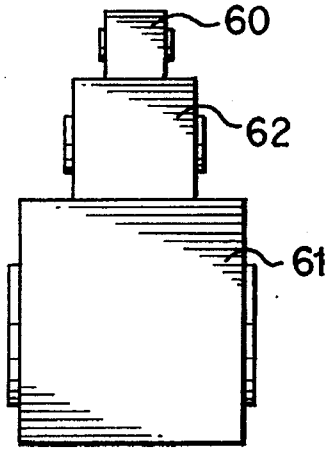
FIG. 10
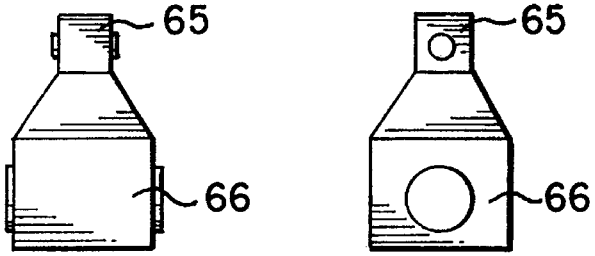
FIG. 13
FIG. 12
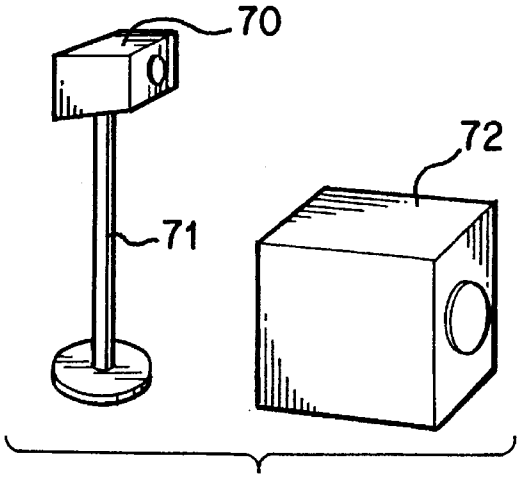
FIG. 14

STEREOPHONIC REPRODUCTION METHOD AND APPARATUS

FIELD OF THE INVENTION

This invention relates to the reproduction of stereophonic sound, and is more in particular directed to an improved method and apparatus enabling the stereophonic effect to more accurately represent the sound of the originating sound source, as well as increasing the area within which a listener can experience true stereophonic sound.

BACKGROUND OF THE INVENTION

In order to enable a better understanding of the invention and the differences between the invention and known systems, a brief description of various known sound reproduction techniques will first be given, as follows:

BINAURAL SOUND-In this reproduction technique, sound is recorded with two microphones positioned to simulate the positions of ears of a human head, to thereby produce a plurality of signals. In order to preserve the binaural effect, during sound reproduction, the listener must wear a set of earphones that are spaced apart the same distance as the recording microphones. Both the amplitude and phase of the sound produced by the earphones are identical to the sound received by the recording microphones. This technique requires a closed circuit system and has the disadvantage that the listener must wear earphones.

MONAURAL SOUND-This sound reproduction technique is also a closed circuit technique, and is similar to the Binaural technique except that it uses only one recording channel. This technique is exemplified by conventional telephone systems.

MONOPHONIC SOUND-As in the case of Monaural sound, only one sound channel is provided in this technique. The system is not a closed system, however, and the reproduction device, however, is in the form of one or more loudspeakers, each of which is energized to emit sound corresponding to the signals on the single channel.

STEREOPHONIC SOUND-This technique employs two (or more) channels, corresponding to sound received directly by microphones at two (or more) spaced apart locations. The optimal stereo recording arrays are known as "ORTF" miking, coincidence miking, near coincidence miking, spaced miking, "SASS" miking and "AMBIPHONIC" miking.

By recording with these techniques, we can "capture" the sounds being recorded in a fashion that better approximates how we hear sounds, while keeping enough differentiating and complementary information.

Another trend of the recording industry, with what is known as a multi (mono) miking and multi (mono) track recording process, is to artificially "locate" the sound of different instruments and sampled sounds by using "panoramic positioners" on the mixers used to feed a two track recording unit. The recording industry calls this a stereo technique, when in effect it should be distinguished as multi track directed mono recordings.

For optimum reproduction, the signals energize separate loudspeakers located at spaced geometrical positions ideally corresponding to the locations of the respective recording microphones' pickup arrays. In this technique, as well as in monophonic sound techniques, the acoustics of the recording location and reproducing location both influence the sound that the user hears, with the result that the sound that is heard even if it should be ideally the same, is not the same as the sound originating from the recorded sound source. Typically about 90% of the sound that is heard in the environment in which the recording was made is reflected sound.

Due to these reflections, the direct musical waves (approximately 10%) give the precision of localization of the origins of the sound of the instruments (e.g. flutes, violins and percussion) while the reflected sounds (approximately 90%) give the ambience of the hall, the depth perception of the soundstage and the richness of the musical experience. The musical emotional experience that a listener, who is in the environment in which the recording was done, has, is due to a complex combination of these reflections of musical information. These are what allow the listener to perceive his environment.

Now remember that the goal of high fidelity is to recreate the musical experience of being present at a concert (regardless of the type of music; jazz, classical, blues, etc.). The only way to accomplish this is to render all the possible sonic information to the brain by the tools that are our ears via a sound reproduction system and also, by consequence, via the most appropriately capable recording processes and techniques.

Assuming that the recordings to be reproduced are capable of "capturing" all the information to be reproduced, and that the more the sound reproduction system is neutral, realistically dynamic and capable of rendering proper transience (including the loudspeakers), the better it should be able to give the basic information that is essential to determine the spacial localization, i.e. the depth and width of the sound stage and even its height. (Our ears/brain combination is indeed capable of indicating if a sound comes from above or below and also what height it originates from. However, it would be trivial to continue at this point on this subject, since it is not relevant to the ability of the present invention to allow the listeners to perceive the information required to locate and hear sounds on the height plane as well.)

What exactly is the effect produced by the sum of this vital information? With his eyes closed, the listener who is relaxed and attentive should see himself "brought" to the location of the recording.

The problem is that both loudspeakers send (ideally with a great neutrality and quality) some complementary information in a less than complementary fashion.

The information sent by each loudspeaker has to be interdependent, at least from a listener's point of view, in order to recreate the spacial coherence and a realistic musical experience.

One type of conventional stereophonic system employs two positioned identical loudspeakers that are energized to provide sound pressure and phase along the plane of symmetry between the two speakers that is the same as at the location of the microphones that were used to record the signal. The plane of symmetry is the central plane that is perpendicular to the line joining the two speakers. In such systems, when the user is not located at the plane of symmetry, the fundamental information is out of phase since the listener is not at a position that is equidistant from the two speakers, and the stereophonic effect is thereby absent.

The fundamental shortcomings of the current trends are the modification of the sounds and the vital micro-information (which are in the harmonic domain) because of the reflection of these on the walls, ceiling, furniture and other objects before their arrival to the ears of the listener. Also, these loudspeakers send the fundamental information out of phase one relative to the other, because the listener is practically never equidistant to the speakers and also because of the reflections of sonic information on all the elements that are in his or her environment.

The result can be a beautiful sound, yes, but not yet recreating, unfortunately, in any way the musical experience perceived by this same listener as if he is situated at the recording location. The goal of high fidelity is therefore not yet achieved.

A good analogy is as follows: the colors are nicely distorted and over and/or undersaturated (depending on the observing point of view and the sampled part of a broad color spectrum) and the image is grossly out of focus and proportion.

Here, we must understand that the human ear locates the point of origin of the sounds that it receives, thanks to the stereophonic perception of our two ears combined together. A sound generated from point "x" (see FIG. 1A) will be perceived simultaneously by the two ears of listener "y". If the point "x" is located right ahead of him, the brain will not register a difference in time perception between the right ear and the left ear because the sound arrives at the same time to both ears. Thanks to this the brain knows that the sound comes from ahead. For sounds coming from the back, there is a difference of perception that the brain is capable of noticing. This difference is due mostly to the shape of the ears that reflect, in a complex manner, the sounds before sending them in towards the tympanies. If, on the other hand, the point "x" is situated on a radius of two o'clock relative to the positioning of "y" (see FIG. 1B) the sound that hits the left ear arrives with a slight delay compared with the sound that the right ear perceives. This is due to the fact that sound travels at about 345 meters per second. The delay is only a few milliseconds. Yet this is enough for the brain to notice the difference and after a fast, automatic subconscious calculation it can determine from where the sound comes. All this is done and noticed thanks to the relative difference in arrival times of the sounds perceived by the right and left ears.

(There are other factors involved in our sonic spacial perceptual abilities. They are related to the "pitch" ("Doppler effect" domain) and "timbre" domain as well as the amplitude domain.)

In conventional stereophonic systems, the left and right reproducing speakers are energized to produce sound waves of the relative same phase as the sound waves recorded by the left and right recording microphones, respectively, in order for the sound produced at the plane of symmetry to duplicate the recorded sound. Application of the signals to the reproducing speakers with phases that are off axis, relative to the phases of the original signals, will not fully simulate the original sound, and hence will not result in faithful reproduction of the recorded sound, even assuming the absence of reflections at the reproduction site.

An example of a conventional system of this type is illustrated in FIG. 1, wherein left and right speakers 10, 11 are spaced apart a distance that preferably represents the distance between the microphones employed to originally record the sound. The speakers 10, 11 are oriented with their major axes parallel to one another, and are energized by the left and right output signals of a conventional stereo amplifier 12. The line 13 in this figure is perpendicular to and centrally intersects a line extending directly between the tips of the cones of the speakers, the line 13 thereby simulates the plane of symmetry of the two speakers. Since every point on the line 13 is equidistant from the two speakers, the temporal relationship of the direct sounds from the two speakers at that point simulates the temporal (as well as the amplitude) relationship of the sound as received by microphones employed to originally record the sound. This temporal relationship is lost, however, at points displaced from the line 13, the divergence from the relationship increasing as the distance from the line 13 increases. It should also be reiterated that in terms of micro-information, there are practically no "sweet spots". This translates into a major shortcoming of currently accepted stereo reproduction/perception and other compromising notions. In systems of this type, the axes of the speakers may alternatively be directed at equal acute angles to the line 13, but such orientation does not generally affect the temporal relationships between sound as above discussed.

In the past, speakers have been positioned at locations that did not simulate the geometry of the recording microphones. For example, U.S. Pat. No. 4,673,057 discloses a system having an assemblage of speakers arranged on each of the faces of a polyhedron, to emit sound in a direction perpendicular to the respective faces, with speakers on one side of an equatorial plane of the polyhedron being energized with the right stereophonic signals and all of the speakers on the other side of the equatorial plane being energized with the left stereophonic signals. The sound pattern produced by such a large number of speakers is very complex, and due to the physical size of the polyhedron, the sound emitted from the opposite sides of the polyhedron simulates sound from a plurality of spaced apart sources. The phase and timing of the sound generated by the speakers hence is quite different than the sound received by the recording microphones.

In one embodiment of the present invention, a sound reproduction system is provided that employs a pair of identical speakers that are mounted "back-to-back". Such a physical arrangement of loudspeakers has been disclosed, for example in U.S. Pat. Nos. 4,268,719 and 4,585,090, only for monophonic systems. U.S. Pat. No. 4,016,953 discloses a system employing a pair of speakers directed toward one another, and energized with identical signals of opposite polarity, in order to provide a push-pull effect for monophonic signals.

SUMMARY OF THE INVENTION

The invention is directed to the provision of a method and apparatus for the reproduction of stereophonic sound, wherein:

1. The stereophonic effect is not limited to the plane of symmetry of a pair of speakers, but is clearly apparent in a region that is substantially independent of the location of a listener.

2. The effects of the acoustics of a sound reproduction room may be canceled in a simple manner, so that the sound heard by a listener can accurately represent the sound that was recorded.

The invention is thus directed to a method and apparatus of phase coherent sonic transmission embodied as a single loudspeaker transmission system. This single complementary transmission system allows the transmission of the left and right channel complementary musical information in a phase coherent and time aligned fashion in order to allow the listeners, regardless of their positions in a listening room, to perceive the music in 4D lifelike fashion.

With the present invention, the right and left complementary sonic information (that is required to be perceived in a time aligned fashion by the listener in order to reconstruct a proper sound stage) is transmitted from the same point source, from a one and only loudspeaker assembly needed to do so. This means that the right and left music signals travel to the listener in a practically parallel and time aligned pattern. This allows the listener to sit or stand wherever he or she wants to in the listening room (with the exception of the 4D generating field zone) and perceive the whole sound stage much more accurately than with a normal loudspeaker array.

The basic benefit of this system is that the one loudspeaker then needed will seem to disappear to the listener while leaving the musical experience of being right where the music was originally recorded. The music will appear and be felt as "live", a definitively more natural experience when listening to music.

Briefly stated, in accordance with the invention, a sound system includes a point source transmission system. First and second complementary monophonic signals, such as left and right complementary monophonic signals, are applied to the transducers in a complementary manner, to result in the temporal alignment and phase coherence of the sound generated by the two complementary signals. The emitted sound produces an interference pattern. It has been found that the brain of the listener is responsive to such a sound pattern in a manner that the listener experiences stereophonic hearing in a region that surrounds the transducer, i.e. not just a region in the vicinity of a plane of symmetry as in known systems.

The transducer may be formed of a pair of speakers mounted back to back, to separately receive the two different mono signals in a complementary manner. When the transmission system is formed of more than one electromagnetic transducer, as in this case, the spacing between the effective points of emission of the two complementary interacting transducers, must be no greater than a critical value. When the transducers are of the cone type, the effective points of emission are considered to be the apices of the transducers' cones (usually near the "spider" suspension).

The invention is also directed to the provision of an improved microphone system for the production of stereophonic signals. The improved microphone system includes a pair of microphone transducers mounted so that the apogees of their respective field of polar response patterns substantially face at 180° to one another. The microphones together are effectively located at a single point, i.e. they are spaced, either physically or by simulation, so that their spacing is (ideally) not greater than the equivalent to the wavelengths of the frequency range of the transducers.

In further embodiments of the invention, since the sound emitting transducers are effectively point source emitters, it is feasible to provide a sound cancellation system to cancel the acoustic trace signature of the room in which the emitters are located. In addition, the phase, amplitude and/or timing of the signals applied to the complementary transducer may be varied in order to "move" the apparent source of the sound.

BRIEF FIGURE DESCRIPTION

In order that the invention may be more clearly understood, it will now be disclosed in greater detail with reference to the accompanying drawings, wherein:

FIGS. 8 and 9 are front and side views, respectively, of one complementary transducer arrangement in accordance with the invention;

FIGS. 10 and 11 are front and side views, respectively, of another complementary transducer arrangement in accordance with the invention;

FIGS. 12 and 13 are front and side views, respectively, of still another complementary transducer arrangement in accordance with the invention;

FIG. 14 is a perspective view of a further arrangement of complementary transducers in accordance with the invention;

DISCLOSURE OF PREFERRED EMBODIMENTS OF THE INVENTION

In the following disclosure, the term "4D" will be employed with reference to the present invention since the invention is based upon the principle of maintaining absolute integrity of reproduction of sound in the four domains of width, height, depth and time, to achieve operation in a controlled fourth dimensional audio temporal and spacial aligned domain.

In accordance with one aspect of the present invention, a stereophonic reproduction system is provided wherein conventional "left" and "right" stereophonic signals are employed to produce sound in a manner that simulates generation of the sound at a "point source transducer", in such a manner that the sound generation resulting from the left and right signals is complementary. The term "complementary", as used herein, refers to the condition in which the two signals energize the complementary transducers to reinforce any common components of sound in the two signals, in substantially every direction of transmission from the transducer, whereby the different phase components of the sound resulting from the two signals is synchronized.

Figure 1:
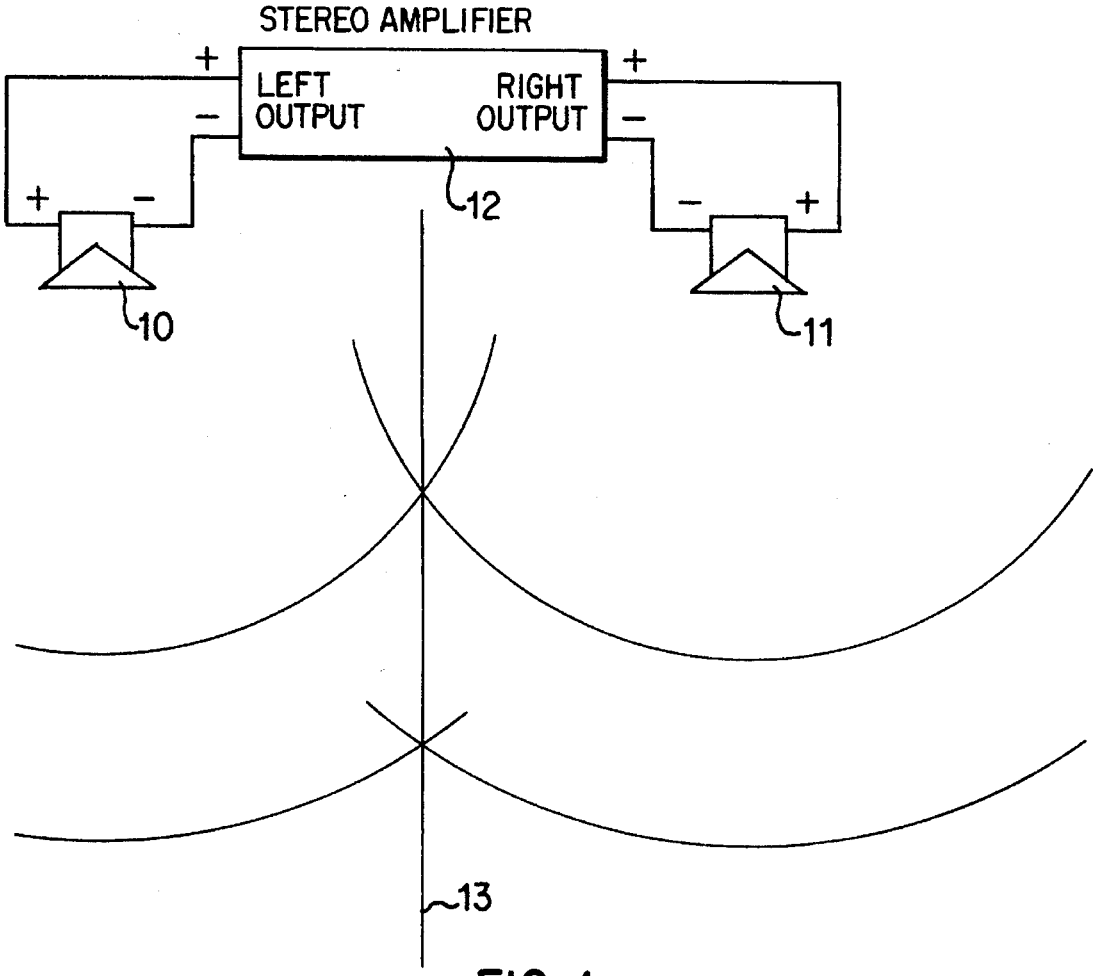
FIG. 1 PRIOR ART
FIG. 1 is a simplified sketch illustrating a conventional stereophonic reproduction system.
Figure 2:
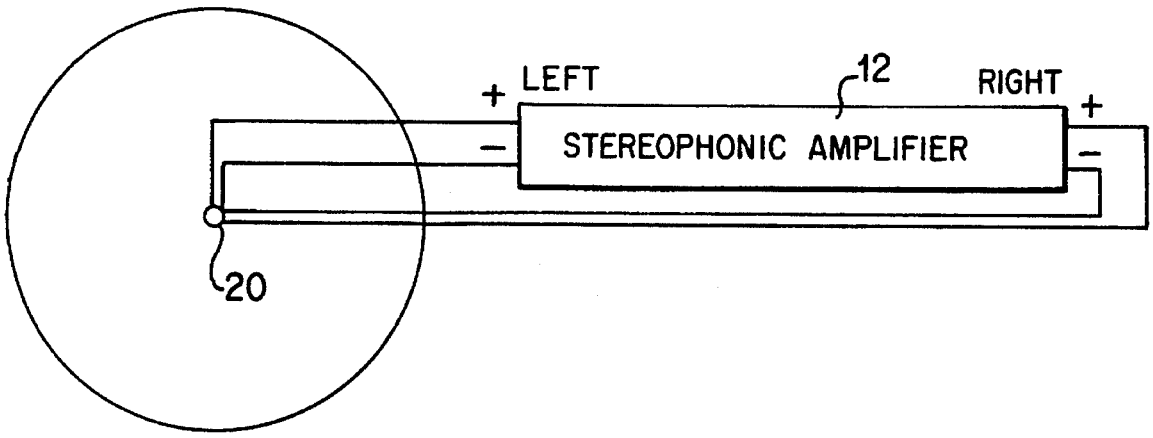
FIG. 2 is a simplified sketch of an ideal system in accordance with the invention.
Figure 1A:
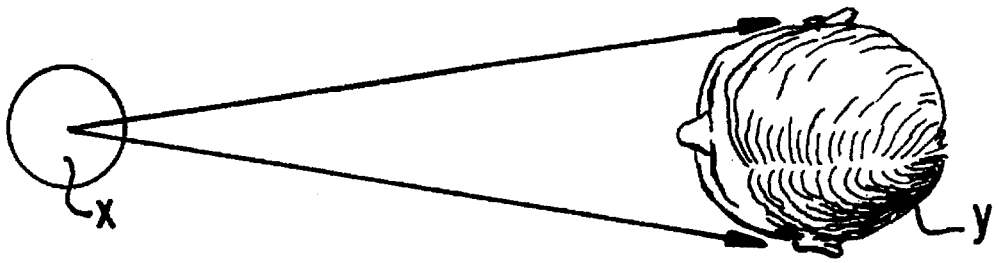
FIG. 1A PRIOR ART
FIGS. 1A and 1B illustrate the reception of sound by a listener at two different positions, in a conventional stereophonic reproduction system.
Figure 1B:
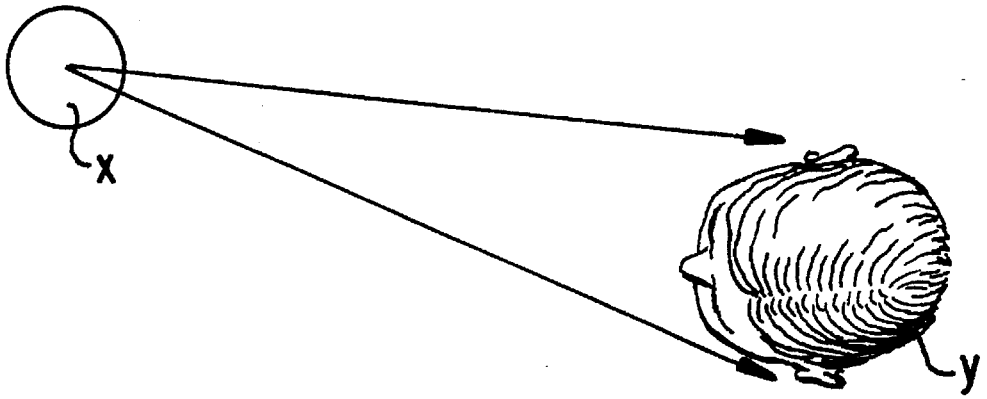
FIG. 1B PRIOR ART

FIG. 2 is a simplified illustration of an ideal system in accordance with the invention. In this arrangement, a "point source transducer" 20 is energized in a complementary manner with the left and right stereo signals from the amplifier 12. It is apparent that every point in the space surrounding the transducer 20 is equidistant from the points at which each of the left and right sound signals is generated.

Figure 3:
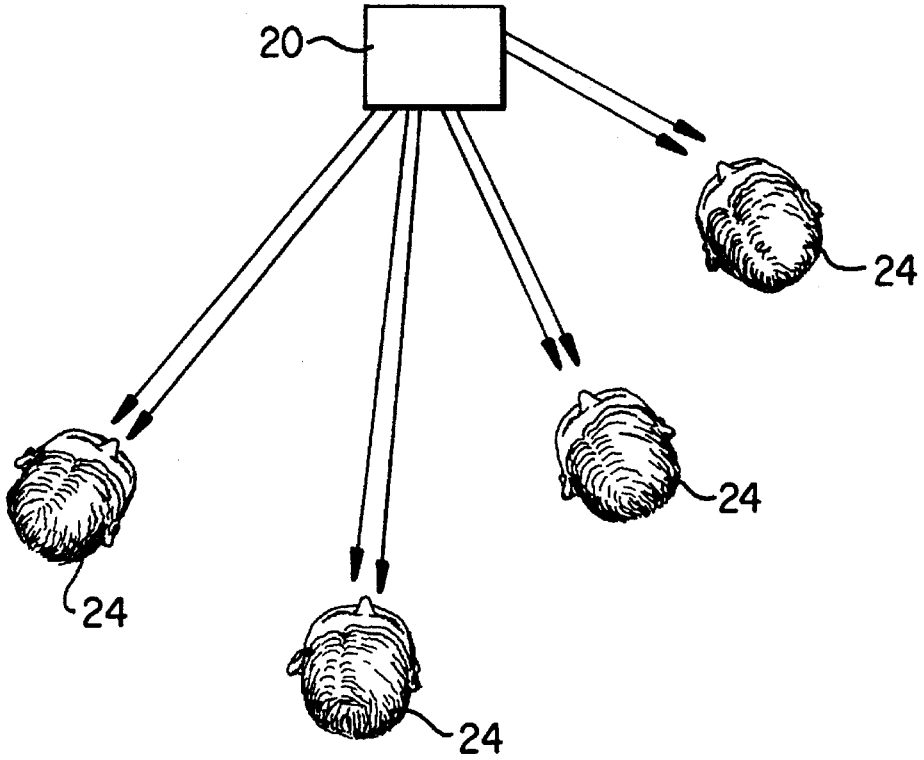
FIG. 3 is a sketch illustrating the independence of the location of the listener, in a 4D system in accordance with the invention.

In a system of the type illustrated in FIG. 2, it has been found that the sound generated by the two signals results in the production of an interference pattern, creating a sound hologram, which results from the time coherence of the complementary information of both channels and the coherence of the two signals. It has further been surprisingly found that this information of the two signals is transmitted effectively in parallel with time alignment to each position surrounding the source 20, such as to the listeners 24, in FIG. 3, at various distances and directions from the transducer 20, such that the listeners' mental processes derive the time and phase information to fully experience the stereophonic effect of the signals. Disregarding the effect of acoustics of the reproduction space, the system of the invention thereby aurally simulates binaural sound without the disadvantage of requiring the use of earphones by the listener, since the 4D recreated sound stage coherence effect that is produced is independent of the position of the listener in the sound field of the transducer.

As above discussed, the two most important criteria of a system and method in accordance with the invention, are that the transducer arrangement simulates, as closely as possible, a point source from which sound corresponding to both of the signals is emitted, and that the complementary transducers are energized by the two complementary channels' signals in a complementary manner. The stereophonic amplifier, as well as the stereophonic signals, may themselves be conventional.

Figure 4:
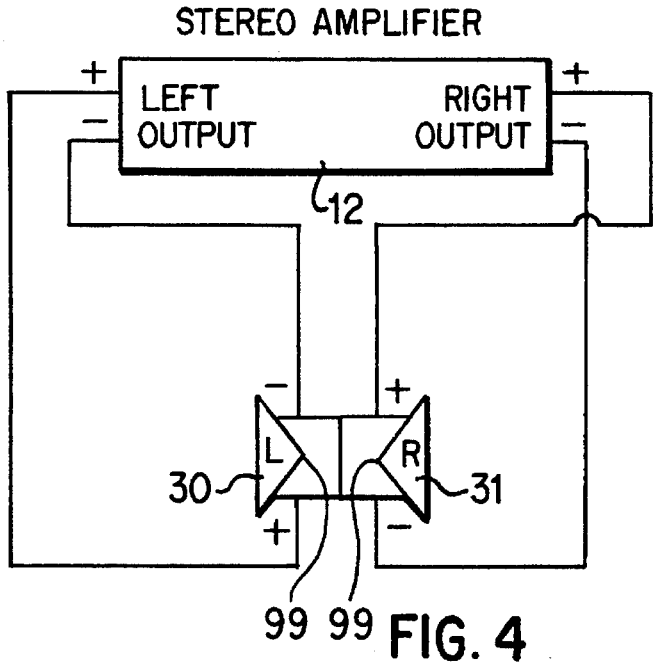
FIG. 4 is an illustration of a two complementary transducer system in accordance with the invention.
Figure 5:
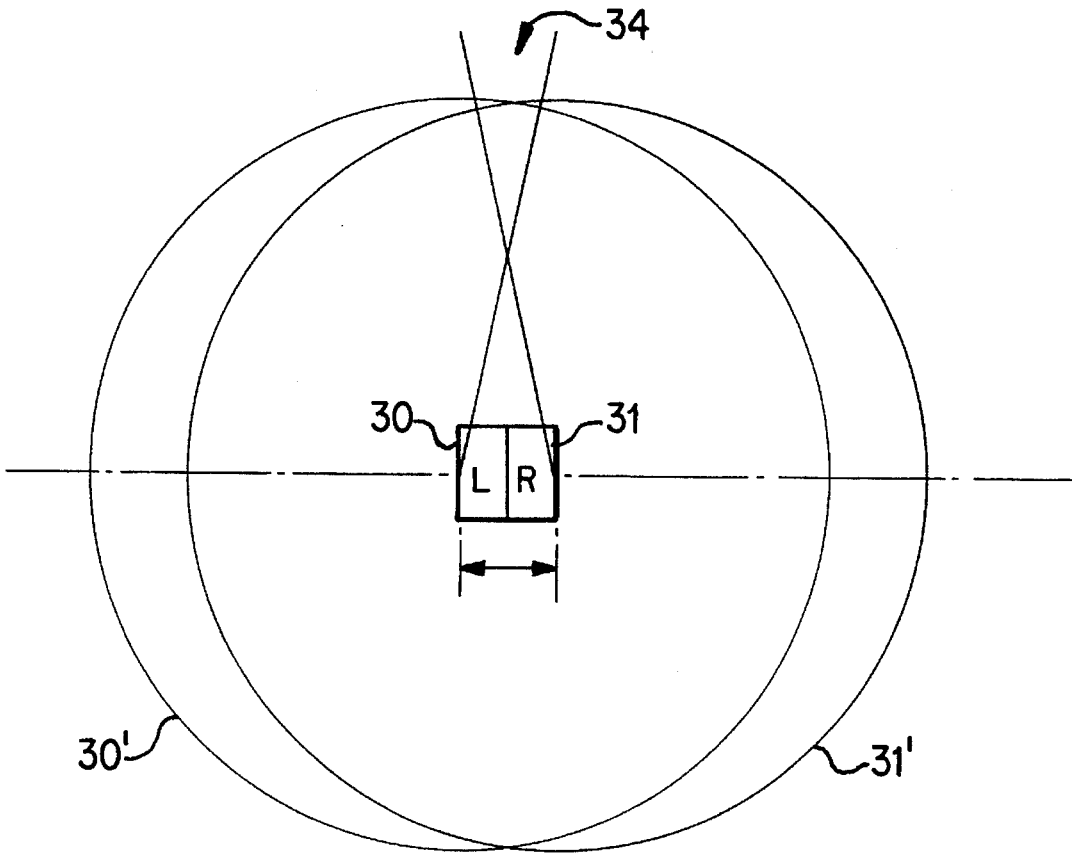
FIG. 5 illustrates the time alignment of a two complementary transducer system in accordance with the invention.

In accordance with one embodiment of the invention, the point source transmission system may be comprised of a pair of identical speakers 30, 31, mounted back to back, as closely as possible, as illustrated in FIG. 4. As above discussed, the speakers are energized from the stereo amplifier 12 in a complementary manner, i.e. such that common components of the sound, from the two signals, reinforce one another in the combined sound pattern. The effective sound patterns from the speakers is illustrated in FIG. 5, wherein equal diameter circles 30', 31' are illustrated centered at the apexes 99 of the cones of these two speakers. The small distance between the two circles depicts the time difference between the arrival of sound from the two speakers, at the respective locations. A small arcuate region 34 adjacent the plane of symmetry of the speakers represents a cross talk zone that can be minimized by mounting the speakers as close together as possible.

Figure 6:
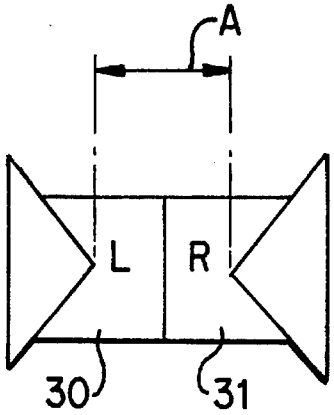
FIG. 6 illustrates a critical dimension of a two complementary transducer system in accordance with the invention.

FIG. 6 illustrates a two speaker system of the above described type, wherein the dimension A represents the distance between the apexes 99 of the cones of the two speakers, i.e. the effective distance between the point sources of sound of the two speakers. In this speaker system the speakers are each connected to reproduce the full range of frequencies of the signals output by the amplifier. It has been found that, for effective stereophonic reproduction of sound in accordance with the invention, the distance A must be no greater than the equivalent wavelength of the highest frequency to be reproduced by the respective speakers. The speaker assembly thus comprises a point source of sound. Greater distances than this result in noticeable degradation of the 4D recreated sound stage coherence effect experienced by the listener. This frequency limitation can be expected to be about 9.5 Khz in conventional speakers.

While, in the above discussed arrangement of two speakers, the speakers have a common axis and emit sound in directions away from one another along the same axis, if the above frequency limitation is maintained they may be arranged to emit sound toward one another. In addition, the axes of the two speakers may be at an angle to one another, for example at 45°, again if the above frequency limitation is maintained. An angular relationship between the axes of the speakers facilitates the cancelation of the acoustic trace signature of the listening room, as will be discussed.

Figure 7:
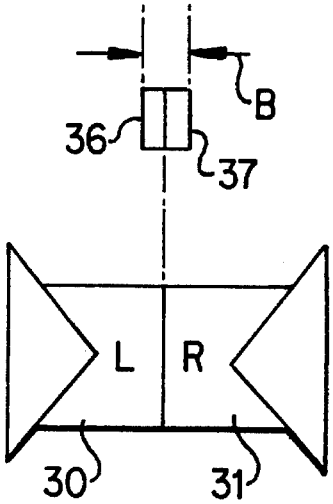
FIG. 7 illustrates a critical dimension of multiple complementary transducers in accordance with the invention, employing a pair of tweeters.

In some speaker systems, in addition to low range speakers 30, 31, tweeters 36, 37 are also provided, as illustrated in FIG. 7. In this type of system, since the distance B between the effective sound source of the tweeters is less than the distance A of the low range speakers, the distance B must be no greater than the equivalent wavelength of the highest frequency to be reproduced. The frequency limitations (in the 4D domain), which are imposed by the traditional design of conventional tweeters, is (depending upon the actual tweeter transducers utilized) about (give or take a few Khz) 12 kHz. The narrower the gap between the point source of both complementary tweeter transducers, in order to achieve the benefits of the present invention, the better the results. This also will translate in a reduction of upper frequency limitations of the invention.

When two speakers are employed to simulate a single point source transducer, the further condition is present, in accordance with the invention, that the "point sources" of the two speakers must be matched to be within the physical distance equivalent wavelengths of the frequency range of the speakers. Thus, if the speakers designed to produce sound up to about 10 kHz, with a wavelength of about 1.3 inches, the distance between the apexes of the cones of the speakers must be no greater than about 1.3 inches.

The invention is not limited to the use of two or more complementary transducers, as discussed above, in the provision of a point source transmission system, and other devices and arrangements may be alternatively employed for this purpose. It is necessary, however, that the transmission system simulate a complementary point source transmission within the above discussed constraints, in order to generate a complementary interference pattern for the listener that his or her brain can interpret to enable the listener to experience the 4D recreated sound stage coherence effect during listening. Thus, for example, a signal processor can be programmed to provide a phase and/or time corrector circuit that simulates a point source of left and right channel information, even if the complementary transducers are spaced at a greater distance than as above discussed.

The complexity of the pattern emitted from a 4D transmission system in accordance with the invention is not sufficiently great that effects of reflection of the sound that is produced cannot be electronically canceled without great difficulty.

When a plurality of complementary transducers are employed, to cover different frequency ranges, they may be mounted in various arrangements. For example, FIGS. 8 and 9 depict the side and front view of a "Dappolito" arrangement having a high frequency complementary transducer 50 mounted on top of a lower frequency complementary transducer 51, and a another low complementary transducer 52 mounted on top of the high frequency unit 50. FIGS. 10 and 11 illustrate the side and front view of a "three voice" arrangement wherein a high frequency complementary transducer 60 is mounted on a mid frequency complementary transducer 61, which is in turn mounted on top of a low frequency unit 62.

In a still further arrangement, FIGS. 12 and 13 illustrate the side and front views of a two voice arrangement wherein a high frequency complementary transducer 65 is mounted on top of a low frequency complementary transducer 66. In a still further arrangement, as illustrated in FIG. 14, a high frequency complementary transducer 70 is mounted on a separate stand 71, adjacent a low frequency complementary transducer 72. This latter embodiment illustrates that, when the different complementary transducers primarily emit sound in different frequency ranges, some tolerance may be permitted in the spacing of the complementary transducers without interfering with the quality of the sound.

While, as above discussed, the complementary transducer reproduction system provides greatly improved high fidelity 4D characteristics independent of the location of the user, even with conventional stereophonic signals, the results can be still further improved by recording the original signals in accordance with a further embodiment of the invention. In the 4D domain, all the aural information must be recorded and codified in a temporal and spacial complementary configuration. In order to "capture" all of the vital complementary information relating to the 4D domain, it has been found desirable to put together, as close as possible, an axially aligned pair of complementary microphone transducers. These transducers should have the apogee of their respective fields of polar (plot) response patterns facing precisely at 180° to one another.

There are, however, alternate transducer configurations that are acceptable, including some where the transducers are not positioned in such a way as to have the apogee of their respective fields of polar (plot) response patterns precisely at 180° to one another, provided that it is ensured that the transducers are within the confines of the critical 4D boundaries, in accordance with the following two requirements:

1. Whatever type of microphone transducer is being used, they must be arranged in such a manner that their left and right channel "point sources" are matched within the physical distance equivalent to the wavelengths of the frequency range of the transducers that are used.

2. Alternatively, if a "phase and/or time" corrector circuit, processor or unit is provided that can permit the simulation of a point source of the left and right channel information in a 4D fashion, even if the transducers for the two channels are spaced apart a distance greater than specified in the first condition, the simulation must meet the first requirement as above discussed.

Figure 15:
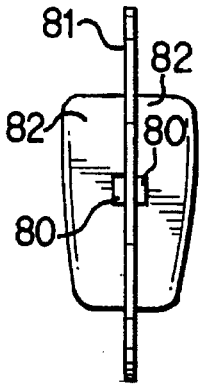
FIGS. 15 and 16 are front and side views, respectively, of one embodiment of a complementary microphone transducer in accordance with the invention.
Figure 16:
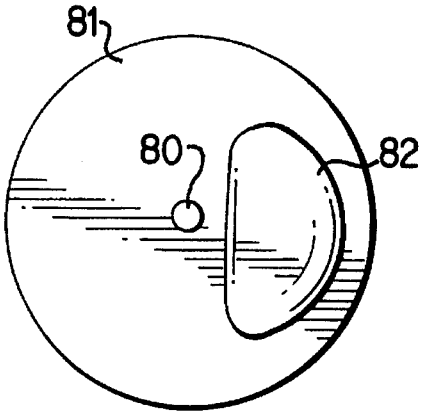

FIGS. 15 and 16 are front and side views, respectively of one embodiment of a complementary microphone transducer system of the invention, wherein a pair of microphone capsules 80 are mounted at the centers of opposite sides of a separation/boundary disk 81. The separation boundary disk 81 has a size and shape determined by the required optimization of the system, using the specific microphone capsules. This disk is thus of a size and shape to prevent each microphone from receiving sound originating at the opposite side of the disk, insofar as possible. The disk is preferably of a material that has a minimum sound reflection.

In addition, a "distinction padder" 82 is affixed to each side of the disk 81. These padders 82 are selected to have a size and shape, and reflectivity characteristic, to optimize the recorded sound fidelity. For example, these padders 82 may be of a conventional sound absorbing material, and of a size and shape to minimize reception of sound from undesired directions.

Figure 17:
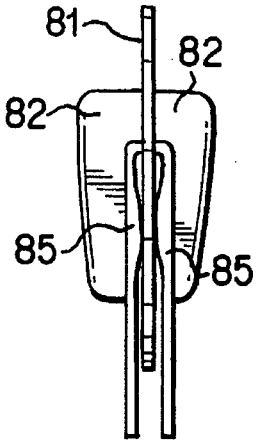
FIGS. 17 and 18 are front and side views, respectively, of another embodiment of a complementary microphone transducer in accordance with the invention.
Figure 18:
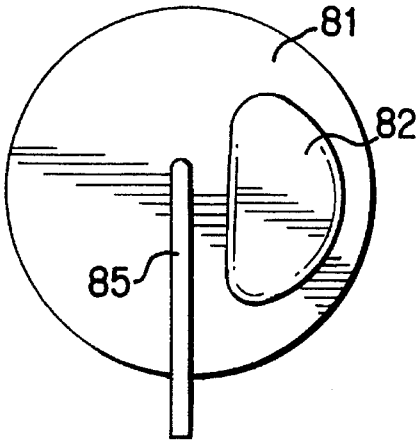
Figure 19:
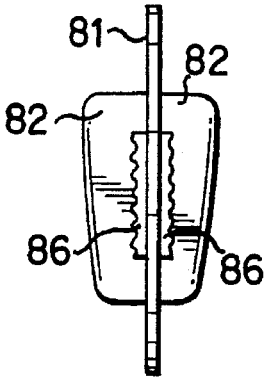
FIGS. 19 and 20 are front and side views, respectively, of still another embodiment of a complementary microphone transducer in accordance with the invention.
Figure 20:
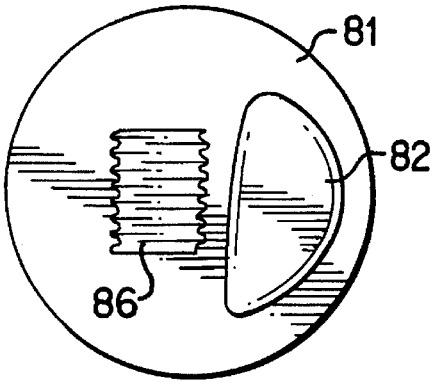

In the modified complementary microphone transducer arrangement of FIGS. 17 and 18, a PZM microphone 85 is provided on each side of the disk 81, and in the modified microphone transducer arrangement of FIGS. 19 and 20, a ribbon microphone 86 is provided on each side of the disk 81.

Figure 21:
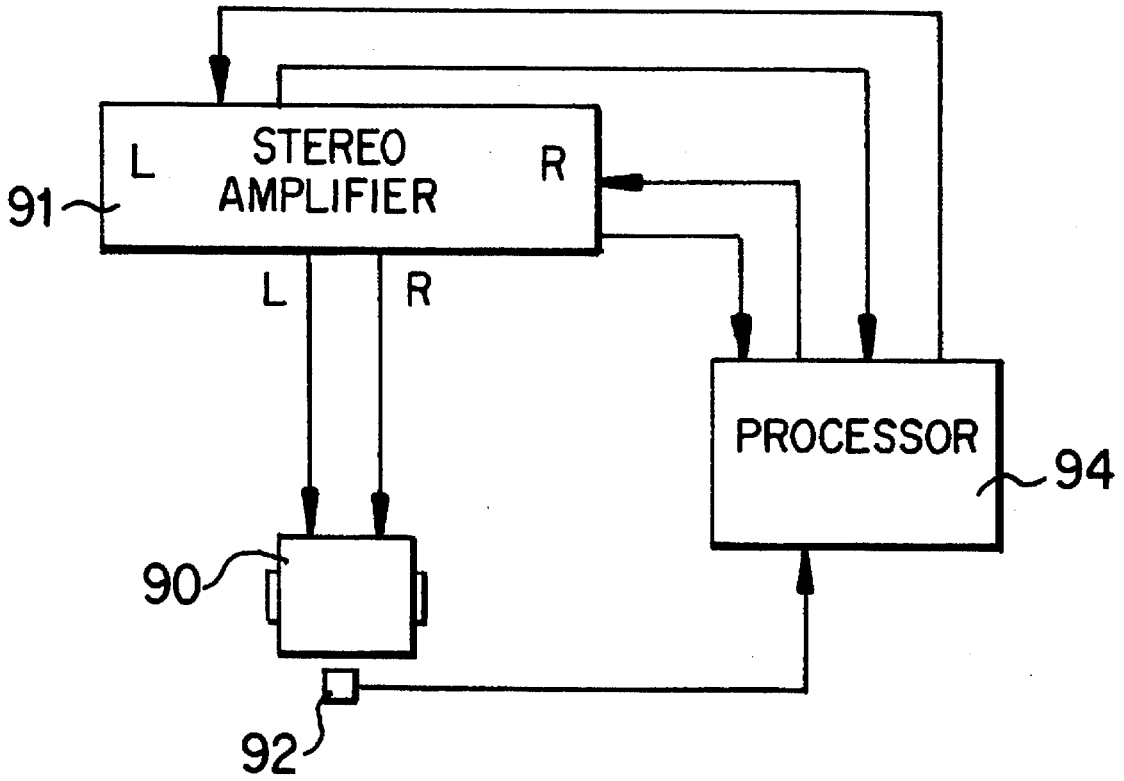
FIG. 21 is a block diagram of a sound cancellation system in accordance with the invention.

Since, as above discussed, the complementary reproduction sound transducers are essentially point sources, the present invention permits the cancellation of sound reflections in a listening room, in order to enable the higher fidelity reproduction of the sound that was actually heard when the sound was recorded. For example, as illustrated in FIG. 21, a complementary transducer 90 is positioned in a listening room and energized with the left and right output signals of a stereo signal source 91, as discussed above. In addition, a point source microphone 92 is located adjacent the complementary transducer 90, to receive sound from the entire listening room. This received sound is applied to a signal processor 94, which subtracts therefrom signals corresponding to the left and right signals originating at the stereo amplifier, in order to avoid interference of the cancellation signal with the desired interference signal. The resultant signal is inverted in the processor and output to the stereo amplifier for application to both the left and right sides of the complementary transducer 90. As a result, the effect of reflections, etc., of the listening room are cancelled. It is of course apparent that more sophisticated arrangements may be alternatively employed in order to improve the sound cancellation effect, i.e. to remove the acoustic trace signature of the listening room.

In a still further embodiment of the invention, it is apparent that the relative phase, amplitude and delay of the stereophonic signals may be controlled in order to "move" sound around listeners, regardless of their listening position. Thus, the source of complementary stereophonic signals may include a processing arrangement to control the phase, amplitude and delay of the respective signals for this purpose.

While the invention has been disclosed and described with reference to a limited number of embodiments, it will be apparent that variations and modifications may be made therein, and it is therefor the aim of the present invention to cover each such variation and modification as falls within the true spirit and scope of the invention.

What is claimed is:

1. A stereophonic sound system comprising:

a transducer means for producing first and second acoustic waves, in accordance with first and second stereophonic signals applied thereto, to effect a virtual point source acoustic pattern as perceived at a listening distance;

said transducer means having first and second acoustic transducers for producing said first and second acoustic waves respectively;

means for fixing said first and second acoustic transducers apart from each other a distance up to and not greater than a wavelength at substantially a highest operational frequency of said transducer means;

said means for fixing disposing said first and second acoustic transducers along a substantially common axis and with said first and second transducers each having respective backsides facing each other; and means for applying first and second different stereophonic signals to first and second acoustic transducers to emit said first and second acoustic waves in correspondence with said first and second different stereophonic signals respectively.

2. The sound system according to claim 1 wherein said upper frequency ranges up to 12 kHz and defines an upper limit of width, height, depth and time coherent operation.

3. The sound system according to claim 2 further comprising means for producing stereophonic acoustic waves at frequencies above said upper frequency.

4. The sound system of claim 1 wherein:

said first and second acoustic transducers each have substantially conical transducer membranes; and said conical transducer membranes have apex areas disposed apart from each other a distance up to and not greater than a wavelength at substantially a highest operational frequency of said first and second acoustic transducers.

5. The sound system according to claim 1 wherein said upper frequency ranges up to 9.5 kHz and defines an upper limit of width, height, depth and time coherent operation.

6. The sound system according to claim 5 further comprising means for producing stereophonic acoustic waves at frequencies above said upper frequency.

7. The sound system according to claim 1 wherein said upper frequency ranges up to 10 kHz and defines an upper limit of width, height, depth and time coherent operation.

8. The sound system according to claim 7 further comprising means for producing stereophonic acoustic waves at frequencies above said upper frequency.

9. A method for reproducing stereophonic sound corresponding to first and second stereophonic signals comprising:

energizing a first transducer with said first stereophonic signal to produce a first acoustic wave pattern;

energizing a second transducer with said second stereophonic signal to produce a second acoustic wave pattern; and disposing said first and second transducers back to back within a distance not greater than a wavelength at about 9.5 KHz.

10. A stereophonic sound system comprising:

at least first and second transducer means for producing acoustic wave patterns;

means for disposing said at least first and second transducer means back to back within a distance of each other of not greater than a wavelength corresponding to an upper frequency of about 9.5 KHz defining temporally aligned and phase coherent operation of said first and second transducer means such that said acoustic wave patterns have virtual effective point sources spaced apart a distance not greater than said wavelength as perceived at a listening distance; and means for energizing said first and second transducer means with first and second stereophonic signals to actuate said first and second transducer means to emit said acoustic wave patterns in correspondence with said first and second stereophonic signals.

11. A stereophonic sound system comprising:

transducer means for producing first and second acoustic wave patterns characterizeable at a listening distance as having first and second effective point sources respectively; and said transducer means including at least first and second transducers;

means for applying first and second stereophonic signals to said first and second transducers respectively; and means for disposing said first and second transducers back to back and within a distance of each other not greater than a limiting distance equal to or less than a wavelength at an operating frequency of said transducer means of about 9.5 KHz to virtually align said first and second effective point sources within said limiting distance of each other as perceivable at a listening distance.

12. The stereophonic sound system of claim 11 wherein:

said first and second traducers are substantially conical transducers;

said first and second effective point sources are virtually located substantially at apex areas of said first and second substantially conical transducers; and said means for disposing disposes said apex areas within a distance of each other not greater than said limiting distance.

13. The sound system according to claim 11 wherein said operating frequency ranges up to 10 kHz and defines an upper limit of width, height, depth and time coherent operation.

14. The sound system according to claim 11 wherein said operating frequency ranges up to 12 kHz and defines an upper limit of width, height, depth and time coherent operation.

15. A stereophonic sound reproduction apparatus comprising:

audio transducers for reproducing sound waves from at least first and second stereophonic audio signals;

said audio transducers including at least first and second transducer means accepting said first and second stereophonic audio signals respectively;

means for mounting said first and second transducer means in substantially opposing directions with backs thereof facing each other;

said means for mounting disposing said first and second transducer means a distance apart not greater than a wavelength at an upper operational frequency limit of said first and second transducer means when said first and second stereophonic audio signals to produce corresponding audio wave fronts in substantial synchronization.

16. The apparatus according to claim 15 wherein:

said first and second transducer means include at least first and second substantially conical transducers, respectively, each having an apex area; and said means for mounting includes means for fixing said apex areas within a distance of each other not greater than a wavelength at an upper operational frequency limit of said first and second transducer means.

17. The sound system according to claim 15 wherein said upper operational frequency limit ranges up to 9.5 kHz.

18. The sound system according to claim 15 wherein said upper operational frequency limit ranges up to 10 kHz.

19. The sound system according to claim 15 wherein said upper operational frequency limit ranges up to 12 kHz.

* * * * *